US007892111B2

(12) United States Patent
Morales et al.

(10) Patent No.: US 7,892,111 B2
(45) Date of Patent: Feb. 22, 2011

(54) GOLF CLUB HEADS WITH A PLURALITY OF STRESS ZONES AND METHODS TO MANUFACTURE GOLF CLUB HEADS

(75) Inventors: Eric J. Morales, Laveen, AZ (US); Anthony D. Serrano, Anthem, AZ (US); Marty R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 162 days.

(21) Appl. No.: 11/772,930

(22) Filed: Jul. 3, 2007

(65) Prior Publication Data

US 2008/0153625 A1 Jun. 26, 2008

Related U.S. Application Data

(63) Continuation-in-part of application No. 11/613,854, filed on Dec. 20, 2006, now Pat. No. 7,361,100, and a continuation-in-part of application No. 11/693,490, filed on Mar. 29, 2007, now Pat. No. 7,601,078.

(60) Provisional application No. 60/884,685, filed on Jan. 12, 2007.

(51) Int. Cl.
*A63B 53/04* (2006.01)

(52) U.S. Cl. ..... 473/345; 473/348

(58) Field of Classification Search ..... 473/345–346, 473/348

See application file for complete search history.

(56) References Cited

U.S. PATENT DOCUMENTS

| | | | | |
|---|---|---|---|---|
| 5,518,243 | A | 5/1996 | Redman | |
| 5,797,807 | A | 8/1998 | Moore | |
| 6,896,006 | B2 | 5/2005 | Lindsay | |
| 6,945,876 | B2 | 9/2005 | Nakahara et al. | |
| 6,955,612 | B2 | 10/2005 | Lu | |
| 7,025,692 | B2 | 4/2006 | Erickson et al. | |
| 7,074,136 | B2 * | 7/2006 | Noguchi et al. | 473/346 |
| 7,166,038 | B2 | 1/2007 | Williams et al. | |
| 7,166,041 | B2 | 1/2007 | Evans | |
| 7,445,564 | B2 * | 11/2008 | Kusumoto | 473/346 |
| 7,510,485 | B2 * | 3/2009 | Yamamoto | 473/345 |
| 7,699,719 | B2 * | 4/2010 | Sugimoto | 473/345 |
| 2003/0130059 | A1 | 7/2003 | Billings | |
| 2004/0147342 | A1 | 7/2004 | Lindsay | |
| 2004/0192468 | A1 * | 9/2004 | Onoda et al. | 473/345 |
| 2004/0266551 | A1 * | 12/2004 | Noguchi et al. | 473/345 |
| 2005/0215354 | A1 | 9/2005 | Kumamoto | |
| 2005/0261082 | A1 * | 11/2005 | Yamamoto | 473/345 |

(Continued)

FOREIGN PATENT DOCUMENTS

| | | |
|---|---|---|
| GB | 2417909 A | 9/2005 |

(Continued)

OTHER PUBLICATIONS

Anthony D. Serrano, et al., "Metal-Organic Composite Golf Club Head," U.S. Appl. No. 10/936,396, filed Sep. 8, 2004.

(Continued)

*Primary Examiner*—Stephen L. Blau

(57) ABSTRACT

Embodiments of golf club heads with a plurality stress zones and methods to manufacture golf club heads are generally described herein. Other embodiments may be described and claimed.

5 Claims, 6 Drawing Sheets

U.S. PATENT DOCUMENTS

| | | | | |
|---|---|---|---|---|
| 2005/0266933 | A1 | 12/2005 | Galloway | |
| 2005/0272527 | A1 | 12/2005 | Sugimoto | |
| 2006/0014592 | A1 * | 1/2006 | Sugimoto | 473/345 |
| 2007/0054751 | A1 | 3/2007 | Breier | |
| 2007/0099727 | A1 * | 5/2007 | Sugimoto | 473/345 |
| 2007/0155539 | A1 * | 7/2007 | Schweigert et al. | 473/345 |

FOREIGN PATENT DOCUMENTS

WO WO 2004/000425 A1 6/2003

OTHER PUBLICATIONS

Anthony D. Serrano, et al., "Metal-Organic Composite Golf Club Head," U.S. Appl. No. 11/545,379, filed Oct. 10, 2006.

Anthony D. Serrano, et al., "Metal-Organic Composite Golf Club Head," U.S. Appl. No. 11/580,490, filed Oct. 13, 2006.

Anthony D. Serrano, et al., "Metal-Organic Composite Golf Club Head," U.S. Appl. No. 11/580,488, filed Oct. 13, 2006.

Bradley D. Schweigert, et al., "Golf Club Head Having a Crown with Thin Regions," U.S. Appl. No. 11/516,373, filed Sep. 6, 2006.

Eric J. Morales, et al., "Metal Composite Golf Club Head," U.S. Appl. No. 11/613,854, filed Dec. 20, 2006.

Jeffrey T. Mergy, et al., "Golf Club Head with Non-Metallic Rear Body," U.S. Appl. No. 11/693,490, filed Mar. 29, 2007.

* cited by examiner

GOLF CLUB HEADS WITH A PLURALITY OF STRESS ZONES AND METHODS TO MANUFACTURE GOLF CLUB HEADS

CROSS REFERENCE TO RELATED APPLICATIONS

This application is a continuation-in-part of application Ser. No. 11/613,854, filed Dec. 20, 2006 now U.S. Pat. No. 7,361,100 and a continuation-in-part of application Ser. No. 11/693,490, filed Mar. 29, 2007, now U.S. Pat. No. 7,601,078 and claims the benefit of U.S. Provisional Application No. 60/884,685, filed Jan. 12, 2007.

TECHNICAL FIELD

The present disclosure relates generally to golf equipment, and more particularly, to golf club heads with a plurality of stress zones and methods to manufacture golf club heads.

BACKGROUND

Golf club heads may be designed to provide greater forgiveness on off-center hits by adjusting the center of gravity (CG) and/or the moment of inertia (MOI) of the golf club heads. For example, one or more apertures may be formed on the top wall portion (e.g., the crown) of a golf club head to reduce weight from the top wall portion. Alternatively, one or more thin sections may be formed on the top wall portion to reduce the weight of the top wall portion. However, the size and/or the location of the aperture(s) or the thin section(s) may affect structural integrity, durability, vibrational feedback, and/or acoustical feedback of a golf club head in response to impact on the face portion (e.g., striking face) of the golf club head.

DESCRIPTION

Figure 1:
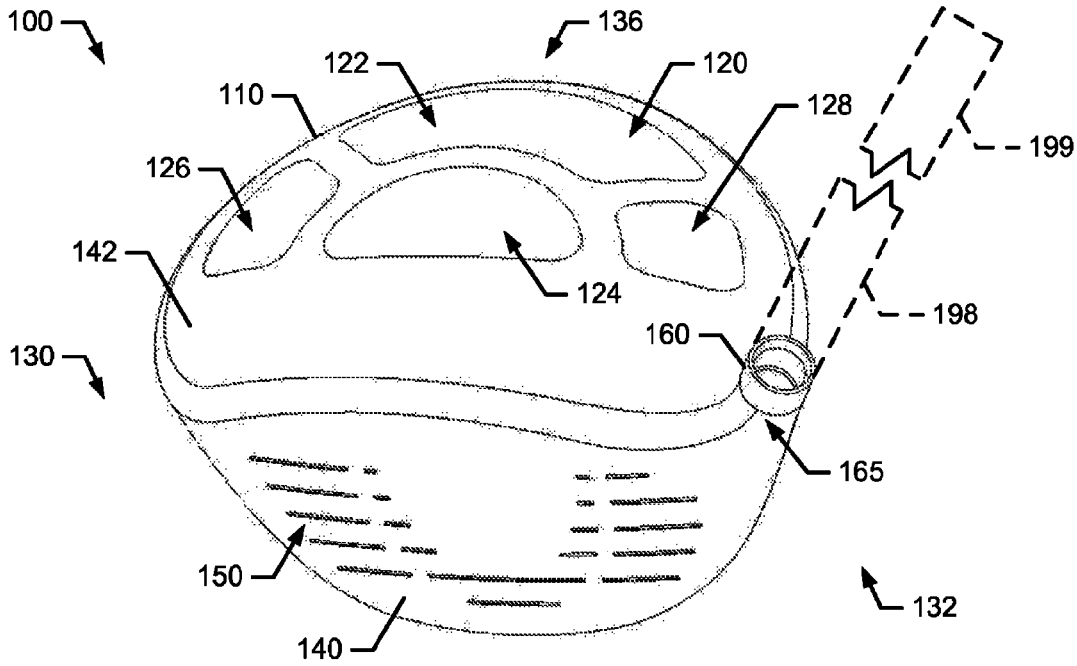
FIG. 1 is a perspective diagram representation of an example golf club head according to an embodiment of the apparatus, methods, and articles of manufacture described herein.

In general, apparatus, methods, and articles of manufacture associated with golf club heads with a plurality of stress zones are described herein. The methods, apparatus, and articles of manufacture described herein are not limited in this regard.

In the examples of FIGS. 1-4, a golf club head 100 may include a body 110. In general, the body 110 may include one or more apertures 120 (generally shown as 122, 124, 126, and 128), a toe end 130, a heel end 132, a front end 134, a back end 136, a face portion 140, a top wall portion 142 (e.g., a crown), a bottom wall portion 144 (e.g., a sole), and a side wall 146 (e.g., a skirt). The body 110 may be made of a metal material such as titanium, titanium alloy, and/or any other suitable materials. As described in detail below, the apertures 120 may include an opening, a slit, a gap, etc. or any combination thereof.

The toe end 130 may be opposite of the heel end 132. In a similar manner, the front end 134 may be opposite of the back end 136. The face portion 140 may be located on the front end 134 and configured to impact a golf ball (not shown). In particular, the face portion 140 may include a plurality of grooves 150. The plurality of grooves 150 may be elongated in a direction between the toe end 130 and the heel end 132 on the face portion 140. The top wall portion 142 may be opposite of the bottom wall portion 144. The side wall 146 may be located between the top wall portion 142 and the bottom wall portion 144 and wrap around the back end 136 of the body 110 between the toe end 130 and the heel end 134.

The golf club head 100 may also include a hosel 160 and a hosel transition 165. For example, the hosel 160 may be located at or proximate to the heel end 132. The hosel 160 may extend from the body 110 via the hosel transition 165. To form a golf club, the hosel 160 may receive a first end of a shaft 198. The shaft 198 may be secured to the golf club head 100 by an adhesive bonding process (e.g., epoxy) and/or other suitable bonding processes (e.g., mechanical bonding, soldering, welding, and/or brazing). Further, a grip 199 may be secured to a second end of the shaft 198 to complete the golf club. The apparatus, methods, and articles of manufacture described herein are not limited in this regard.

Figure 2:
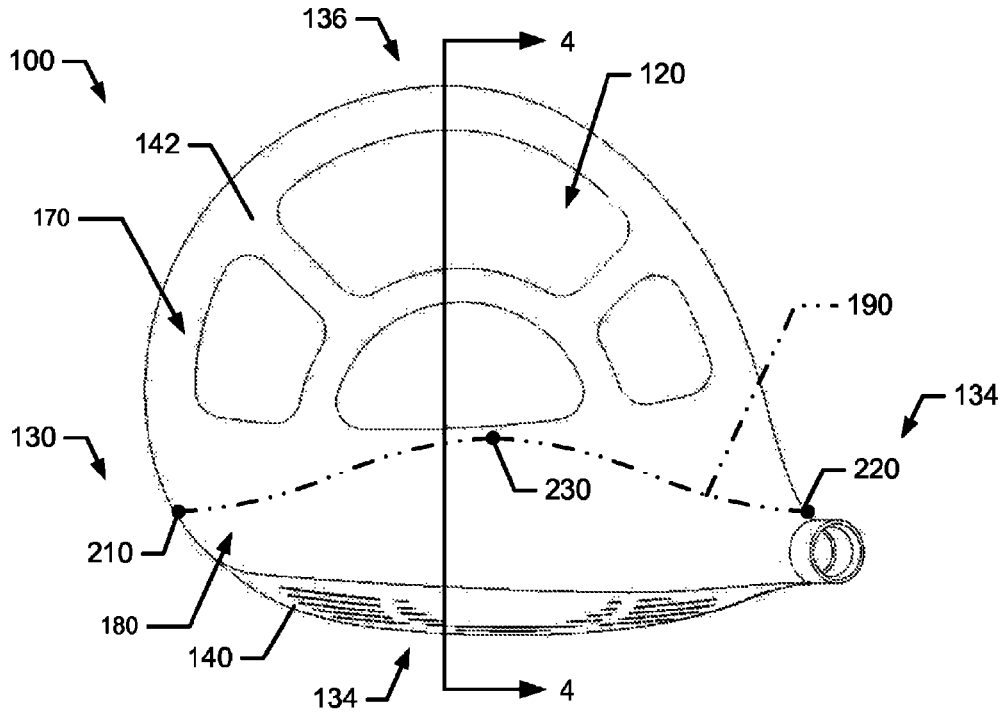
FIG. 2 depicts a top view of the example golf club head of FIG. 1.

The body 110 may include a first zone 170 and a second zone 180. The second zone 180 may sustain or endure relatively more stress than the first zone 170 in response to impact on the face portion 140. In one example, the first and second zones 170 and 180 may be defined by one or more bell-shaped curves (e.g., shape of normal distribution), generally shown as 190 and 195 in FIGS. 2 and 3, respectively. Referring to FIG. 2, for example, a first bell-shaped curve 190 may include a first point 210, a second point 220, and a third point 230. The first point 210 may be located at or proximate to the toe end 130 of the body 110. The second point 220 may be located at or proximate to the heel end 132 of the body 110). The third point 230 may be located at or proximate to a distal point on the top wall portion 142 from the face portion 140 (e.g., at or proximate to the center of the first bell-shaped curve 190).

The first bell-shaped curve 190 may represent a boundary between the first and second zones 170 and 180 on the top wall portion 142. In particular, the first bell-shaped curve 190 may indicate where one or more of the apertures 120 may be located on the top wall portion 142 to optimize the center of gravity and/or the moment of inertia without substantially compromising structural integrity, durability, vibrational feedback, and/or acoustical feedback of the golf club head 100. The apparatus, methods, and articles of manufacture described herein are not limited in this regard.

Figure 3:
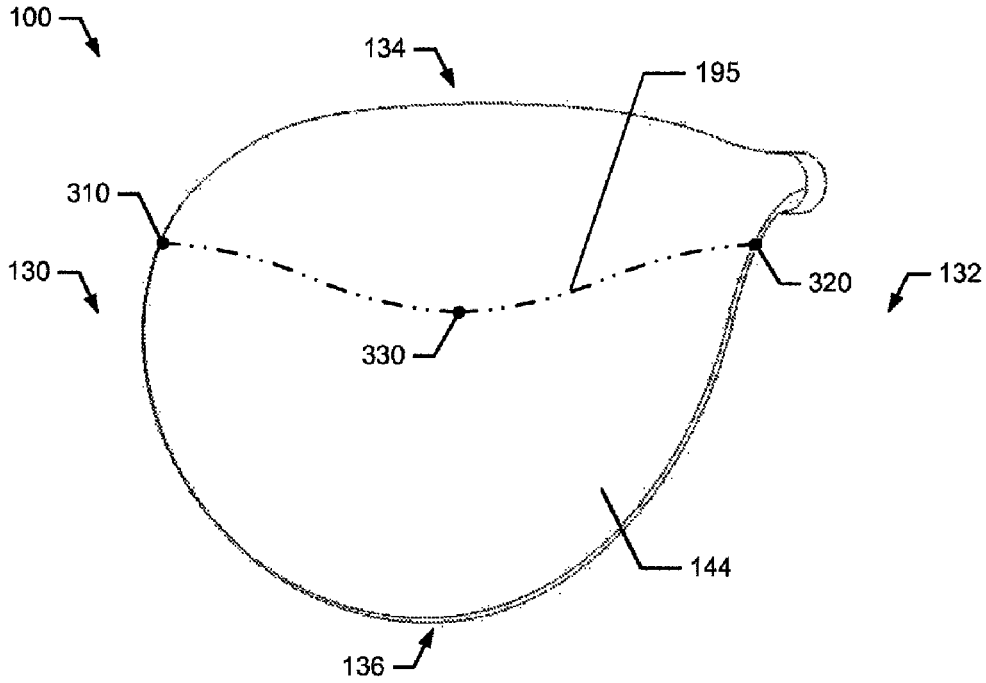
FIG. 3 depicts a bottom view of the example golf club head of FIG. 1.

Turning to FIG. 3, for example, a second bell-shaped curve 195 may also include a first point 310, a second point 320, and a third point 330. The first point 310 may be located at or proximate to the toe end 130 of the body 110. The second point 320 may be located at or proximate to the heel end 132 of the body 110. The third point 330 may be located at or proximate to a distal point on the bottom wall portion 144 from the face portion 140 (e.g., at or proximate to the center of the second bell-shaped curve 195).

In a similar manner as the first bell-shaped curve 190, the second bell-shaped curve 195 may represent a boundary between the first and second zones 170 and 180 on the bottom wall portion 144. In particular, the second bell-shaped curve 195 may indicate where one or more of the apertures 120 may be located on the bottom wall portion 144 to optimize the center of gravity and/or the moment of inertia without substantially compromising structural integrity, durability, vibrational feedback, and/or acoustical feedback of the golf club head 100. The apparatus, methods, and articles of manufacture described herein are not limited in this regard.

Figure 4:
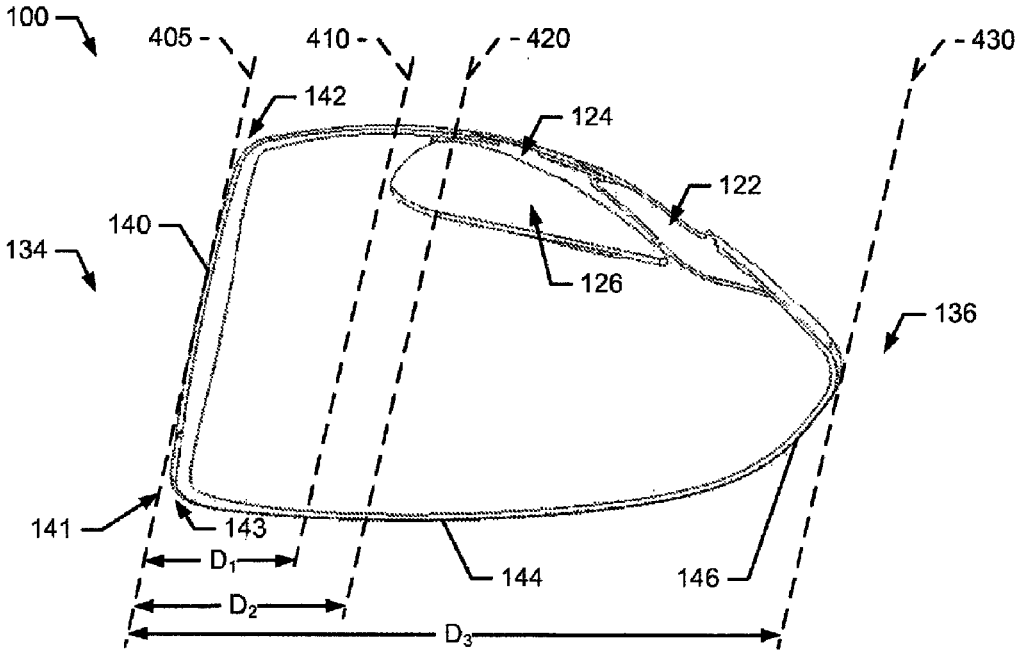
FIG. 4 depicts a cross sectional view of the example golf club head of FIG. 1.

In the example of FIG. 4, the first and second bell-shaped curves 190 and 195 may be based on a loft plane 405, a first plane 410, and a second plane 420. The first and second planes 410 and 420 may be substantially parallel to each other and to the loft plane 405. In particular, the first plane 410 may be a first distance ($D_1$) from the loft plane 405 whereas the second plane 420 may be a second distance ($D_2$) from the loft plane 405. The first and second points 210 and 220 of the first bell-shaped curve 190 may be located on the first plane 410. The first and second points 310 and 320 of the second bell-shaped curve 195 may also be located on the first plane 410. The third point 230 of the first bell-shaped curve 190 may be located on the second plane 420. The third point 330 of the second bell-shaped curve 195 may also be located on the second plane 420.

The first and second points 210 and 220 of the first bell-shaped curve 190 may be relatively closer to the loft plane 405 than the third point 230 of the first bell-shaped curve 190 because an area substantially proximate to the third point 230 may sustain or endure more stress than areas substantially proximate to the first and second points 210 and 220. In a similar manner, the first and second points 310 and 320 of the second bell-shaped curve 195 may be relatively closer to the loft plane 405 than the third point 330 of the second bell-shaped curve 195 because an area substantially proximate to third point 230 may sustain or endure more stress than areas substantially proximate to the first and second points 210 and 220.

In particular, the first zone 170 may extend between the back end 136 and the first and second bell-shaped curves 190 and 195 whereas the second zone 180 may extend between the front end 134 and the first and second bell-shaped curves 190 and 195. The first zone 170 may include the apertures 120 to redistribute weight of the golf club head 100 without substantially compromising structural integrity, durability, vibrational feedback, and acoustical feedback of the golf club head 100. That is, the weight of the top wall portion 142 and/or the bottom wall portion 144 may be reduced with the apertures 120. In contrast, the second zone 180 may not include any apertures to avoid substantially compromising structural integrity, durability, vibrational feedback, and/or acoustical feedback of the golf club head 100 in response to impact on the face portion 140. With the apertures 120 located within the first zone 170, the center of gravity and/or the moment of inertia of the golf club head 100 may be optimized. Without any apertures located within the second zone 180, structure integrity, durability, vibrational feedback, and acoustical feedback of the golf club head 100 may be maintained as if the first zone 170 did not include any apertures.

As mentioned above, the apertures 120 may be configured on the golf club head 100 without substantially compromising structural integrity, durability, vibrational feedback, and/or acoustical feedback of the golf club head 100 in response to impact on the face portion 140. Instead of maximizing the size of the apertures 120 (e.g., a heart shape or V-shaped aperture extending substantially from the first bell-shaped curve 190 to the back end 136 and from the toe end 130 to the heel end 132 on the top wall portion 142) to maximize the amount of weight to redistribute from the top wall portion 142, for example, the size of the apertures 120 may be configured as described herein to optimize the amount of weight to redistribute from the top wall portion 142 while substantially maintaining structural integrity, durability, vibrational feedback, and acoustical feedback of the golf club head 100.

In contrast to other golf club heads, the first distance $D_1$ may be measured relative to the loft plane 405 instead of a leading edge 141 of the golf club head 100 or a top end 142 of the face portion 140. In a similar manner, the second distance $D_2$ may be measured relative to the loft plane 405 instead of the leading edge 141 of the golf club head 100 or a bottom end 143 of the face portion 140 (e.g., the leading edge 141 of the golf club head 100 may be the bottom end of the face portion 140). In one example, the first distance $D_1$ may be less than or equal to 0.75 inches and the second distance $D_2$ may be less than or equal to 1.3 inches for a golf driver head (e.g., the golf club head 100). For golf fairway wood heads, golf hybrid heads, or other types of golf club heads, the first and second distances $D_1$ and $D_2$ may be less than or equal to 0.75 inches and 1.3 inches, respectively. While the above example may describe particular distances relative to the loft plane 405, the methods, apparatus, and articles of manufacture described herein may include other distances for the first and second distances $D_1$ and $D_2$.

The golf club head 100 may include a third distance ($D_3$) extending between the loft plane 405 and a third plane 430. For example, the third distance $D_3$ may be the length of the golf club head 100. The loft plane 405 and the third plane 430 may be substantially parallel to each other. Thus, the first, second, and third planes 410, 420, and 430 may also be substantially parallel to each other. The third plane 430 may include the back end 136 of the golf club head 100. In one example, the third distance $D_3$ may be 4.0 inches. Accordingly, the first distance $D_1$ may be less than or equal to 18.75% of the third distance $D_3$, and the second distance $D_2$ may be less than or equal to 32.5% of the third distance $D_3$. For golf fairway wood heads, golf hybrid heads, or other types of golf club heads, the first and second distances $D_1$ and $D_2$ may be less than 18.75% and 32.5% of the third distance $D_3$, respectively. While the above example may describe particular percentages relative to the third distance $D_3$, the methods, apparatus, and articles of manufacture described herein may include other percentages for the first and second distances $D_1$ and $D_2$. The methods, apparatus, and articles of manufacture described herein are not limited in this regard.

Although the above examples describe various portions and/or surfaces of the golf club head 100, the golf club head 100 may not include certain portions and/or surfaces. For example, while FIGS. 1-4 may depict the top wall portion 142, the bottom wall portion 144, and the side wall 146 as separate surfaces, the side wall 146 may merge with either the top wall portion 142 or the bottom wall portion 144 into a single surface of the hollow body 110 (e.g., the body 110 may include the top wall portion 142 and the bottom wall portion 144 but not the side wall 146). In one example, the bottom wall portion 144 and the side wall 146 may merge into a single bottom surface of the body 110. Further, although FIGS. 1-4 may depict the hosel 160 and the hosel transition 165, the golf club head 100 may not include the hosel 160 and/or the hosel transition 165. In one example, the golf club head 100 may include a bore (not shown) within the body 110 to receive the shaft 198 (e.g., an opening of the bore may be flushed with the top wall portion 142).

Figure 5:
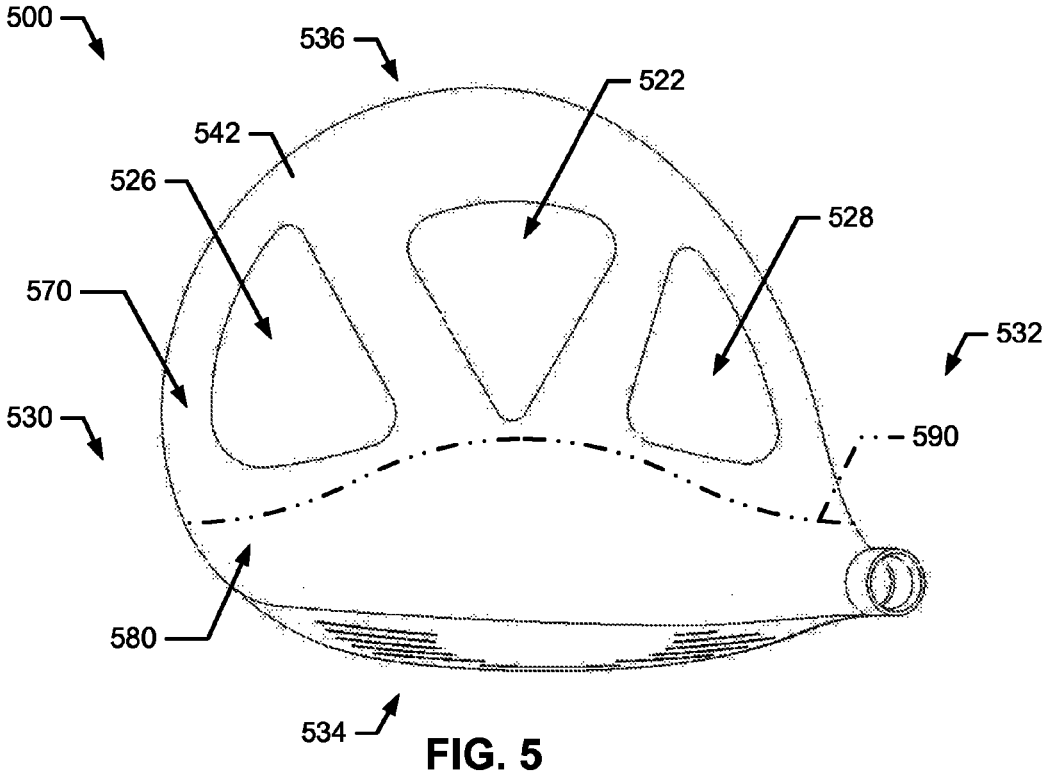
FIG. 5 depicts a top view of another example golf club head.

Further, one or more of the apertures 120 may configure alignment indicia. In the example of FIG. 5, a golf club head 500 may include a toe end 530, a heel end 532, a front end 534, a back end 536, a top wall portion 542, a first zone 570, and a second zone 580. The first and second zones 570 and 580 may be defined by a bell-shaped curve 590. In particular, the first zone 570 may extend between the back end 536 and the bell-shaped curve 590 whereas the second zone 580 may extend between the front end 534 and the bell-shaped curve 590. To redistribute weight of the golf club head 500 without substantially compromising structural integrity, durability, vibrational feedback, and acoustical feedback of the golf club head 500, the first zone 570 may include the one or more apertures, generally shown as 522, 526, and 528. In one example, the aperture 522 may be a triangular shape aperture. The triangular shape aperture 522 may be located within the first zone 570 of the top wall portion 540 between two side apertures 526 and 528. Further, the triangular shape aperture 522 may extend between the back end 565 and the bell-shaped curve 590 to serve as an alignment indicator. The alignment indicator may indicate where an individual should align the golf club head 500 with a golf ball.

Although FIG. 5 depicts the side apertures 526 and 528 to further optimize the center of gravity and/or the moment of inertia of the golf club head 500, the golf club head 500 may not include one or more of the side apertures 526 and 528. While FIG. 5 depicts a particular shape, the golf club head 500 may include a circular shape aperture, a square shape aperture, a rectangular aperture, and/or any other suitable shape of apertures. The apparatus, methods, and articles of manufacture described herein are not limited in this regard.

Figure 6:
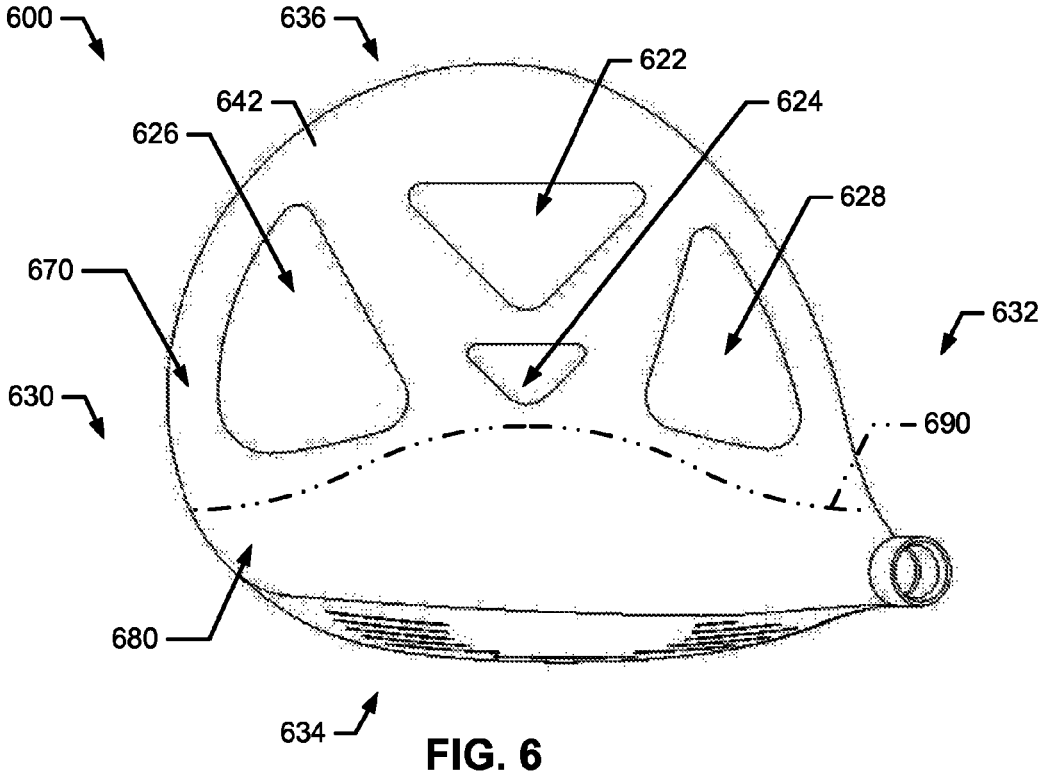
FIG. 6 depicts a top view of another example golf club head.

In another example as illustrated in FIG. 6, for example, a golf club head 600 may include a toe end 630, a heel end 632, a front end 634, a back end 636, a top wall portion 642, a first zone 670, and a second zone 680. The first and second zones 670 and 680 may be defined by a bell-shaped curve 690. In particular, the first zone 670 may extend between the back end 636 and the bell-shaped curve 690 whereas the second zone 680 may extend between the front end 634 and the bell-shaped curve 690. To redistribute weight of the golf club head 600 without substantially compromising structural integrity, durability, vibrational feedback, and acoustical feedback of the golf club head 600, the first zone 670 may include one or more apertures, generally shown as 622, 624, 626, and 628. In particular, the golf club head 600 may include a first triangular shape aperture 622 and a second triangular shape aperture 624. The first and second triangular shape apertures 622 and 624 may be located within the first zone 670 of the top wall portion 640 between two side apertures 626 and 628. Further, the first and second triangular shape apertures 622 and 624 may be located between the back end 665 and the bell-shaped curve 690 to serve as an alignment indicator. The alignment indicator may indicate where an individual should align the golf club head 600 with a golf ball.

The first and second triangular shape apertures 622 and 624 may be equal or vary in size. In one example, the first triangular shape aperture 622 may be relatively larger than the second triangular shape aperture 624. Although FIG. 6 may depict a relatively smaller triangular shape aperture (e.g., the second triangular shape aperture 624) located relatively closer to a bell-shaped curve 690 than a relatively larger triangular shape aperture (e.g., the first triangular shape aperture 622), the golf club head 600 may include a relatively larger triangular shape aperture (e.g., the first triangular shape aperture 622) located relatively closer to the bell-shaped curve 690 than a relatively smaller triangular shape aperture (e.g., the second triangular shape aperture 624). That is, the first and second triangular shape apertures 622 and 624 may switch positions relative to the bell-shaped curve 690. Alternatively, the golf club head 600 may include one or more arrow-shaped apertures. The apparatus, methods, and articles of manufacture described herein are not limited in this regard.

Figure 7:
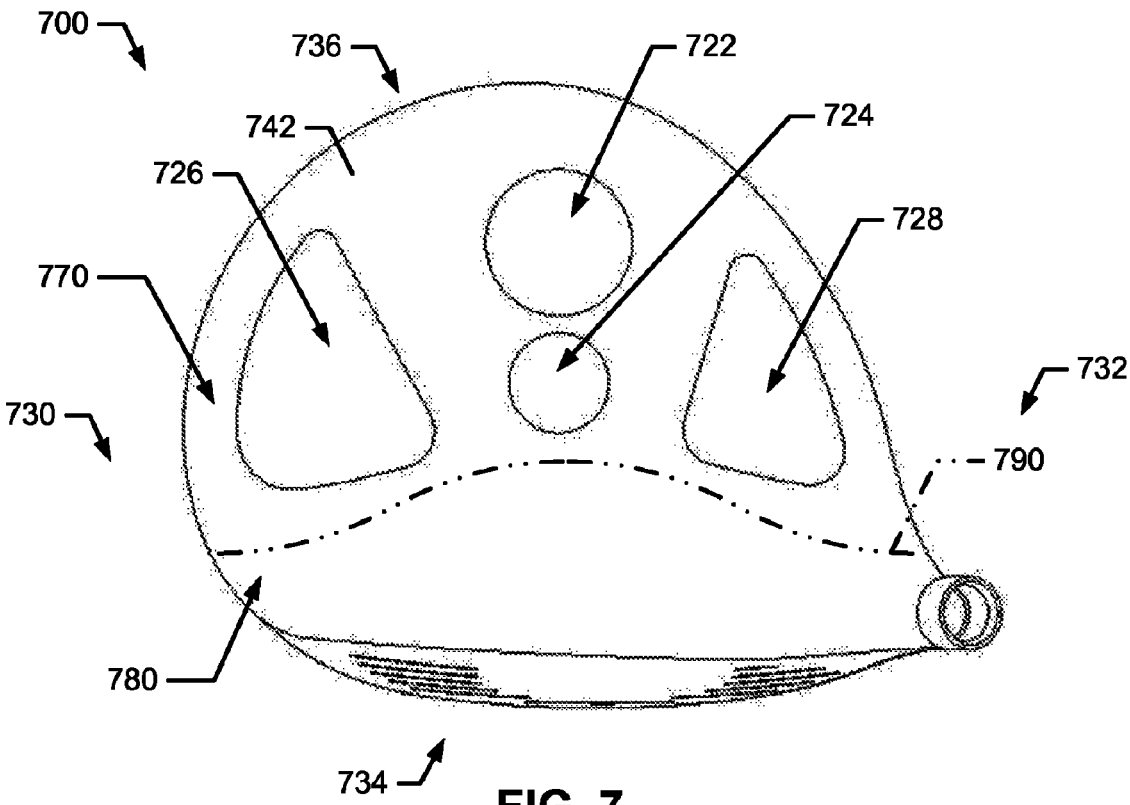
FIG. 7 depicts a top view of another example golf club head.

Turning to FIG. 7, for example, a golf club head 700 may include a toe end 730, a heel end 732, a front end 734, a back end 736, a top wall portion 742, a first zone 770, and a second zone 780. The first and second zones 770 and 780 may be defined by a bell-shaped curve 790. In particular, the first zone 770 may extend between the back end 736 and the bell-shaped curve 790 whereas the second zone 780 may extend between the front end 734 and the bell-shaped curve 790. To redistribute weight of the golf club head 600 without substantially compromising structural integrity, durability, vibrational feedback, and acoustical feedback of the golf club head 700, the first zone 770 may include one or more apertures, generally shown as 722, 724, 726, and 728. In particular, the golf club head 700 may include a first circular shape aperture 722 and a second circular shape apertures 724. The first and second circular shape apertures 722 and 724 may be located within the first zone 770 of the top wall portion 740 between two side apertures 726 and 728. Further, the first and second circular shape apertures 722 and 724 may be located between the back end 736 and the bell-shaped curve 790 to serve as an alignment indicator. The alignment indicator may indicate where an individual should align the golf club head 700 with a golf ball.

The first and second circular shape apertures 722 and 724 may be equal or vary in size. In one example, the first circular shape aperture 722 may be relatively larger than the second circular shape aperture 724. The first and second circular shape apertures 722 and 724 may be less than, greater than, or equal to a golf ball. Although FIG. 7 may depict a relatively smaller circular shape aperture (e.g., the second circular shape aperture 724) located relatively closer to a bell-shaped curve 790 than a relatively larger circular shape aperture (e.g., the first circular shape aperture 722), the golf club head 700 may include a relatively larger circular shape aperture (e.g., the first circular shape aperture 722) located relatively closer to the bell-shaped curve 790 than a relatively smaller circular shape aperture (e.g., the second circular shape aperture 724). That is, the first and second circular shape apertures 722 and 724 may switch positions relative to the bell-shaped curve 790. The apparatus, methods, and articles of manufacture described herein are not limited in this regard.

While the above examples may depict particular sizes and shapes of apertures, the apparatus, methods, and articles of manufacture described herein may include apertures configured in various sizes and/or shapes to provide optimal vibrational and/or acoustical feedbacks in response to impact and to maintain or improve structural integrity and durability of golf club heads. Although FIGS. 1-7 may depict a particular number of apertures, the body 110 may include more or less apertures (e.g., a single aperture). Further, as described in detail below in connection with FIGS. 8 and 9, one or more of the apertures 120 may be enclosed or covered.

Further, although FIGS. 1-7 may depict a utility club head or a metal wood-type club head (e.g., drivers, fairway woods, etc.), the methods, apparatus, and articles of manufacture described herein may be readily applicable to other suitable types of golf club heads. For example, the methods, apparatus, and articles of manufacture described herein may be applicable to hybrid-type club heads or other suitable types of golf club heads. The methods, apparatus, and articles of manufacture described herein are not limited this regard.

Figure 8:
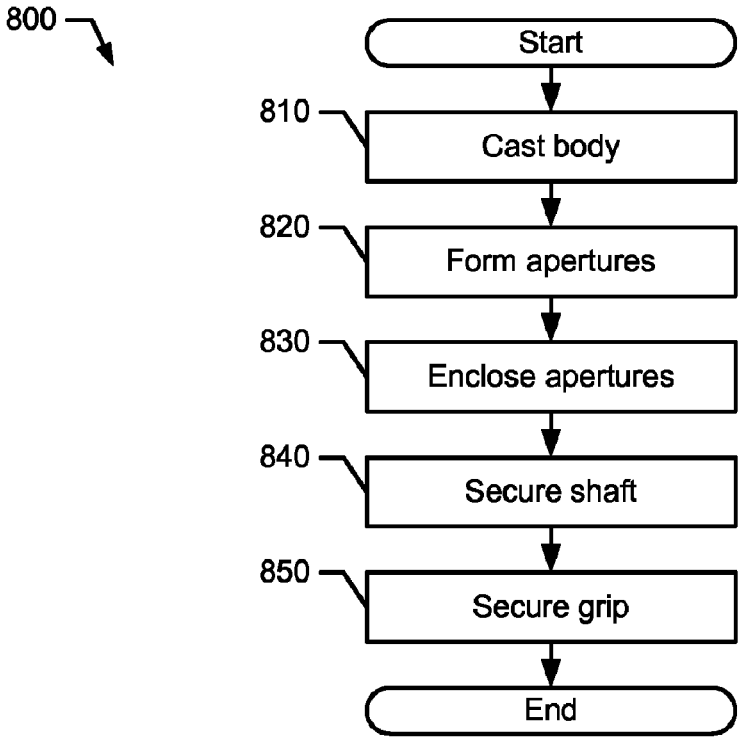
FIG. 8 is a flow diagram representation of one manner in which the example golf club head of FIG. 1 may be manufactured.

In the example of FIG. 8, a process 800 may begin with casting the body 110 (FIG. 1) to form the golf club head 100 (block 810). As noted above, for example, the body 110 may be made of a metal material (e.g., titanium, titanium alloy, etc.). To optimize the CG and/or increase the MOI, the process 800 may form the one or more apertures 120 (e.g., the apertures 122, 124, 126, and/or 128 of FIG. 1) (block 820).

Figure 9:
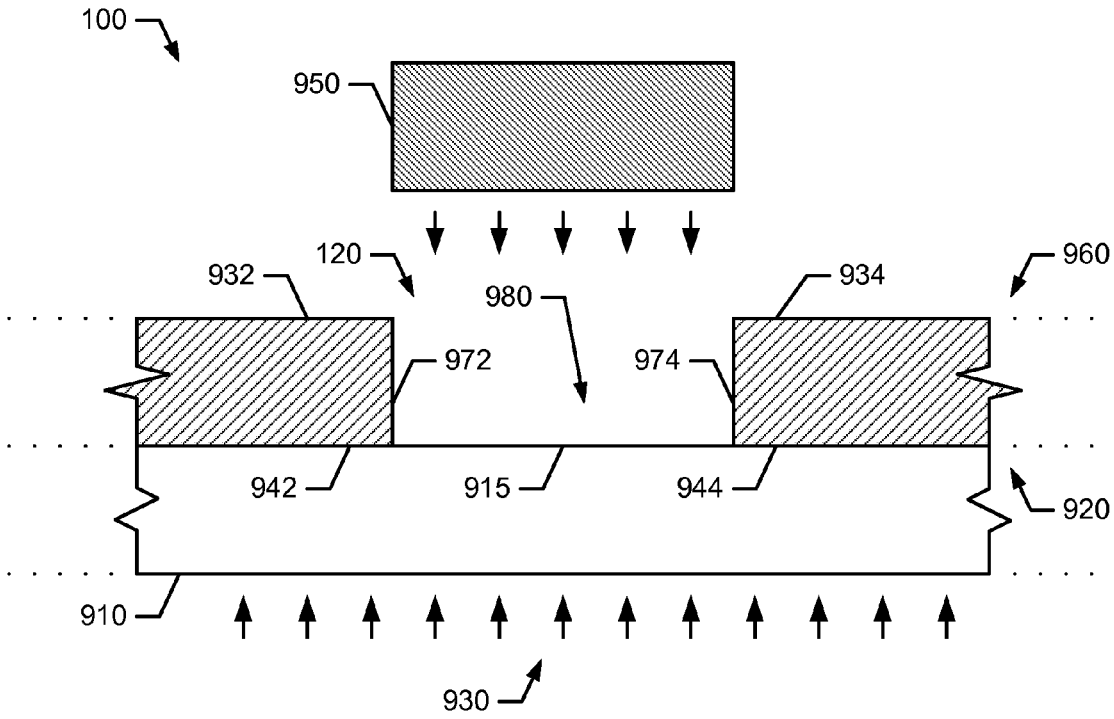
FIG. 9 depicts a cross-sectional view of a portion of the example golf club head of FIG. 1.

Accordingly, the process 800 may enclose the apertures 120 (block 830). In one example, the process 800 may use a bladder mold process to enclose the apertures 120. Referring to FIG. 9, for example, an insert sheet 910 may enclose or cover the apertures 120 from the inside 920 of the body 110 (FIG. 1) with a suitable adhesive (e.g., epoxy). A bladder (not shown) may be inserted into the body 110 through an opening (not shown), which may be located on or proximate to the top wall portion 142, the bottom wall portion 144, and/or the side wall 146. The bladder may be inflated to assert pressure 930 on the insert sheet 910 to bond with one or more non-aperture portions of the body 110, generally shown as 932 and 934. In particular, a top side 915 of the insert sheet 910 may be secured to a bottom side 942 of the non-aperture portion 932 and a bottom side 944 of the non-aperture portion 934 of the body 110. Accordingly, the bladder may be removed through the opening after the insert sheet 910 is secured to the inside of the body 110.

Further, an insert 950 may enclose or cover the apertures 120 form the outside 960 of the body 110. For example, the insert 950 may be made a relatively light-weight material such as a thermoplastic material, a composite material, and/or other suitable type of light-weight materials. Each of the non-aperture portions 932 and 934 may include a side wall 972 and 974, respectively. Accordingly, the top side 915 of the insert sheet 910 and the side walls 972 and 974 may form a cavity 980. The insert 940 may fill in the cavity 980.

Instead of the bladder mold process as described above, the apertures 120 may be covered from the outside 960 of the body 110 with the insert 950. That is, the insert 950 may not be supported from the inside 930 of the body 110 with the insert sheet 910. The insert 950 may enclose or cover the apertures 120 by securing to the side walls 972 and 974 of the non-aperture portions 932 and 934, respectively.

Turning back to FIG. 8, the hosel 160 may receive a first end of the shaft 198 to form a golf club. The shaft 198 and the body 110 (via the hosel 160) may be secured to each other by an adhesive bonding process (e.g., epoxy) and/or other suitable bonding processes (e.g., mechanical bonding, soldering, welding, and/or brazing) (block 840). To complete the golf club, a grip 199 may receive a second end of the shaft 198. The shaft 198 and the grip 199 may be secured to each other by an adhesive bonding process and/or other suitable bonding processes (block 850). The methods, apparatus, and articles of manufacture are not limited in this regard.

Although the process 800 may be described above with respect to the golf club head 100, the process 800 may be applicable to other golf club heads. Further, while a particular order of actions is illustrated in FIG. 8, these actions may be performed in other temporal sequences. For example, two or more actions depicted in FIG. 8 may be performed sequentially, concurrently, or simultaneously.

Figure 10:
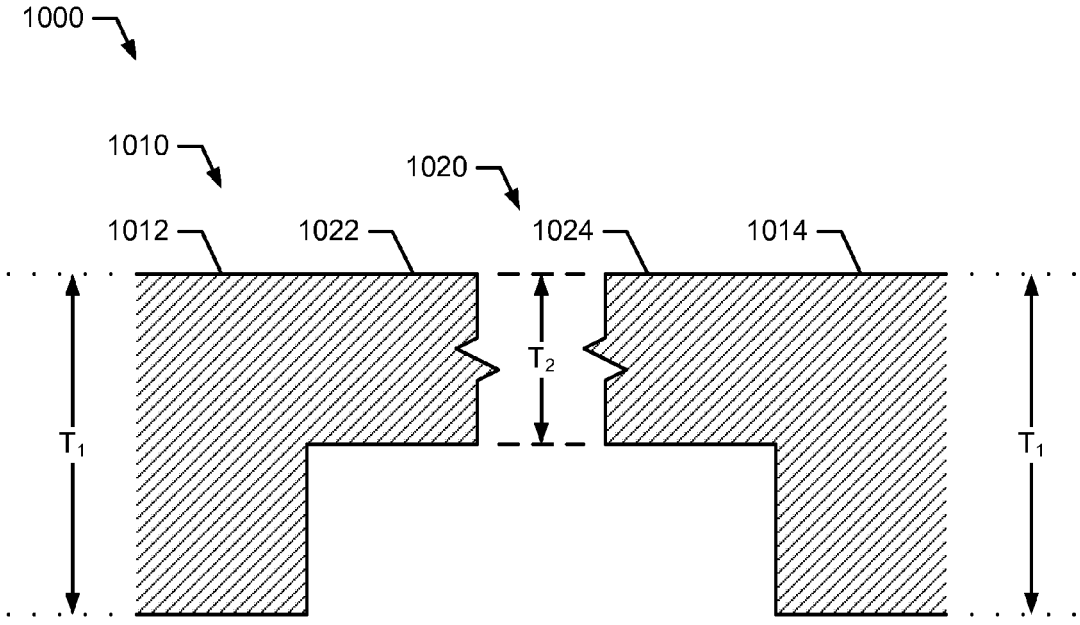
FIG. 10 depicts a cross-sectional view of a portion of an example golf club head.

While the above examples may be described with respect to apertures, the apparatus, methods, and articles of manufacture described herein may include relatively thin portions instead of apertures to optimize the CG and/or increase the MOI of club heads. In the example of FIG. 10, a golf club head 1000 may include one or more first thickness portions 1010, generally shown as 1012 and 1014, and one or more second thickness portions 1020, generally shown as 1022 and 1024. The first thickness portions 1010 may be associated with a first thickness ($T_1$) whereas the second thickness portions 1020 may be associated with a second thickness ($T_2$). In general, the first thickness portions 1010 may be relatively thicker than the second thickness portions 1020 (e.g., $T_1>T_2$). While FIG. 10 may depict uniform and particular thickness, the thickness of the first thickness portions 1010 and/or second thickness portions 1020 may vary with the first thickness portions 1010 being relatively thicker than the second thickness portions 1020. The methods, apparatus, and articles of manufacture are not limited in this regard.

Referring back to FIG. 1, the golf club head 100 may include a combination of apertures and thin regions to redistribute weight from the top wall portion 142 and/or the bottom wall portion 144 while maintaining structural integrity, durability, vibrational feedback, and acoustical feedback of the golf club head 100. In one example, the top wall portion 142 may include one or more apertures (e.g., the apertures 120) whereas the bottom wall portion 144 may include one or more thin regions. In another example, the top wall portion 142 may include a combination of apertures and thin regions. The bottom wall portion 144 may also include a combination of apertures and thin regions. The methods, apparatus, and articles of manufacture are not limited in this regard.

Figure 11:
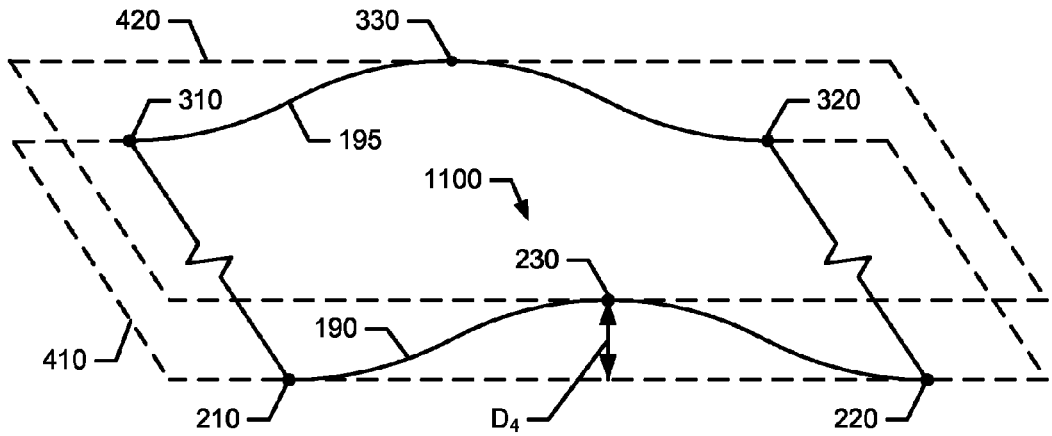
FIG. 11 depicts a perspective view of a cross-sectional area associated with example bell-shaped curves of the example golf club head of FIG. 1.

Although the above examples may depict the first and second bell-shaped curves 190 and 195 (FIG. 1) as lines extending between the toe end 130 and the heel end 132 on the top wall portion 142 and the bottom wall portion 144, respectively, the first and second bell-shaped curves 190 and 195 may form a cross-sectional area 1100 between the first and second planes 410 and 420 (e.g., FIG. 4) as depicted in FIG. 11. In particular, the third point 230 of the first bell-shaped curve 190 may be a fourth distance ($D_4$) between the first and second planes 410 and 420. The fourth distance $D_4$ may be the difference between the first and second distances (e.g., $D_4=D_2-D_1$). The methods, apparatus, and articles of manufacture are not limited in this regard.

Figure 12:
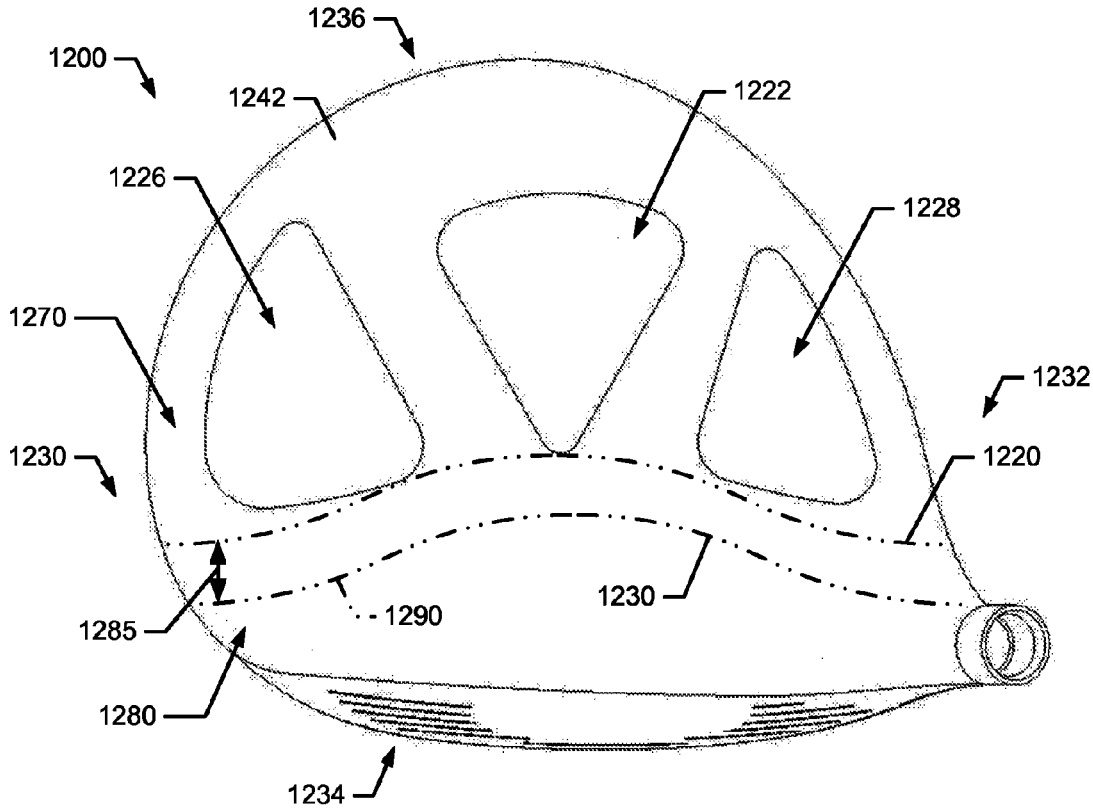
FIG. 12 depicts a top view of another example golf club head.

In the example of FIG. 12, a golf club head 1200 may include a toe end 1230, a heel end 1232, a front end 1234, a back end 1236, a face portion 1240, a top wall portion 1242, a first zone 1270, a second zone 1280, and a bell-shaped curve 1290. In particular, the first zone 1270 may extend between the back end 1236 and the bell-shaped curve 1290 whereas the second zone 1280 may extend between the front end 1234 and the bell-shaped curve 1290. To redistribute weight of the golf club head 1200 without substantially compromising structural integrity, durability, vibrational feedback, and acoustical feedback of the golf club head 1200, the first zone 1270 may include one or more apertures, generally shown as 1222, 1226, and 1228.

The golf club head 1200 may also include a third zone 1285. In particular, the third zone 1285 may include an upper bound 1220 and a lower bound 1230. For example, the first bell-shaped curve 1290 may be the lower bound 1230 of the third zone 1285. The first zone 1270 may extend between the upper bound 1220 and the back end 1230, and the second zone 1280 may extend between the lower bound 1230 and the front end 1234. Accordingly, the third zone 1285 may sustain or endure relatively more stress than the first zone 1270 but relatively less stress than the second zone 1280.

In particular, the third zone 1285 may compensate for the hardness associated with various golf balls (e.g., the core of the golf balls). In one example, relatively softer golf balls may inflict more stress on the body 110 via the face portion 140 than relatively harder golf balls. That is, hard and soft golf balls may inflict substantially the same magnitude of stress on the face portion 140. However, relatively softer golf balls may inflict stress on the body 110 via the face portion 140 for a relatively longer period of time than relatively harder golf balls because relatively softer golf balls may deform and/or compress more than relatively harder golf balls. To account for relatively softer golf balls, the apertures 1222, 1226, and 1228 may located between the upper bound 1220 of the third zone 1285 and the back end 1236.

In contrast, relatively harder golf balls may inflict stress on the body 110 via the face portion 140 for a relatively less period of time than relatively softer golf balls. To account for relatively harder golf balls, the apertures 1222, 1226, and 1228 may be located between the lower bound 1230 of the third zone 1285 (e.g., the first bell-shaped curve 1290) and the back end 1236. Referring back to FIG. 5, for example, the apertures 522, 526, and 528 may be located between the first bell-shaped curve 590 and the back end 536. The methods, apparatus, and articles of manufacture are not limited in this regard.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A golf club head comprising:

a body having a toe end, a heel end, a front end, a back end, a face portion, a top wall portion, and a bottom wall portion, a first stress zone including one or more thin portions relatively thinner than other portions and extending between the back end and a bell-shaped curve associated with a stress load threshold, the bell-shaped curve extending between the toe portion and the heel portion, a second stress zone extending between the front end and the bell-shaped curve, wherein the first stress zone is associated with a stress load less than or equal to the stress load threshold in response to impact on the face portion, wherein the second stress zone is associated with a stress load greater than the stress load threshold in response to impact on the face portion, wherein the bell-shaped curve extends a variable distance from a loft plane substantially parallel to the face portion between a first point associated with the toe end and a second point associated with the heel end and the bell-shaped curve extends a maximum distance from the loft plane at or proximate to a midpoint between the first and second points, and wherein at least one of the first and second points extends 0.75 inches from the loft plane, and the midpoint extends 1.3 inches from the loft plane.

2. The golf club head of claim 1, wherein at least one of the one or more thin portions is located on the top wall portion.

3. The golf club head of claim 1, further comprising a third zone having a lower bound and an upper bound, wherein the lower bound comprises the bell-shaped curve and wherein the upper bound extends between the toe end and the heel end and is located between the back end and the lower bound.

4. The club head of claim 1, wherein at least one of the one or more thin portions comprises a thin portion associated with an annular-like shape.

5. The club head of claim 1, wherein the one or more thin portions comprises at least four thin portions.

* * * * *